United States Patent [19]

Perovetz et al.

[11] Patent Number: 4,999,054

[45] **Date of Patent: * Mar. 12, 1991**

[54] GOLD PLATING SOLUTIONS, CREAMS AND BATHS

[75] Inventors: Lawrence M. Perovetz, Stanmore, England; Nagendra N. Bhattacharya, Greenway Tylers Green, United Kingdom

[73] Assignee: Lamerie, N.V., Jersey, Channel Islands

[ * ] Notice: The portion of the term of this patent subsequent to May 23, 2006 has been disclaimed.

[21] Appl. No.: 130,074

[22] Filed: Dec. 8, 1987

Related U.S. Application Data

[63] Continuation-in-part of Ser. No. 944,333, Dec. 19, 1986, Pat. No. 4,832,743.

[51] Int. Cl.[5] ..... C23C 3/00

[52] U.S. Cl. ..... 106/1.23; 106/1.26; 106/1.05; 106/3

[58] Field of Search ..... 106/1.26, 1.23, 3; 262/105; 427/443.1, 437; 51/293, 307–309

[56] References Cited

U.S. PATENT DOCUMENTS

| | | | |
|---|---|---|---|
| 3,123,484 | 3/1964 | Pokras | 106/1 |
| 3,506,462 | 4/1970 | Oda | 106/1 |
| 4,270,932 | 6/1981 | Perovetz et al. | 51/293 |
| 4,798,626 | 1/1989 | Perovetz et al. | 106/123 |

FOREIGN PATENT DOCUMENTS

| | | |
|---|---|---|
| 0219788 | 4/1987 | European Pat. Off. . |
| 661647 | 7/1938 | Fed. Rep. of Germany . |
| 1536414 | 6/1967 | France . |

*Primary Examiner*—Josephine Barr

[57] ABSTRACT

Non-toxic, non-electrolytic solutions, creams and immersion baths are provided for gold plating metallic items such as silver, copper, nickel, brass and gold alloys, as well as silver plated or gold plated items. Water soluble gold salts are used, together with reducing compounds. Water soluble gold salts can also be used with complexing compounds and stabilizers. For convenience, the gold plating ingredients may be combined with salts to form tablets or powders. Addition of water to the tablets or powder provides the novel solutions and immersion baths. The ingredients can also be reached with the metallic item in the presence of a metallic reaction enhancer. The amount of gold generating compound in the solutions and creams is selected to either replenish or maintain the amount of gold on an item which already has a gold surface.

82 Claims, No Drawings

GOLD PLATING SOLUTIONS, CREAMS AND BATHS

This is a continuation-in-part of U.S. patent application Ser. No. 944,333, filed Dec. 19, 1986 now U.S. Pat. No. 4,332,743.

BACKGROUND OF THE INVENTION

The invention relates to non-toxic, non-electrolytic solutions, creams and baths for plating gold onto metallic items such as silver, copper, brass, nickel and gold alloys, as well as onto items which have been previously silver plated or gold plated. The solutions and creams are particularly useful for consumers, because they are easy to use and non-toxic. The baths are particularly useful in industry for gold plating such products as computer and electronic components, as well as for manufacturing jewelers. They may also be used to convert silver jewelry into gold plated jewelry in the home. The baths do not require expensive electrolytic plating equipment. Solutions and creams are also provided which polish as well as gold plate metallic items.

DESCRIPTION OF THE PRIOR ART

Various methods exist for the plating of metallic objects with gold. Electrolytic plating has long been used, but is impractical for consumer use, and is costly and requires special precautions for industrial use. Electroless plating methods most commonly involve the use of compositions which contain a cyanide compound. Cyanide compounds present problems with toxicity which render them unsuitable for consumer use and require precautions for industrial use. Other methods involve the use of amines which have an unpleasant odor and may also present toxicity problems.

Some methods require cleaning of the object prior or subsequent to plating with gold. Such two-step procedures are inconvenient and time-consuming. Still other methods require pretreatment such as activation or sensitization of the surface to be plated. Additional methods require the plating to be carried out at greater than ambient temperatures. All of these methods are impractical or time-consuming for consumer use and involve extra expense for industrial use.

SUMMARY OF THE INVENTION

Accordingly, it is an object of this invention to provide non-toxic solutions which may be applied directly to metal items to gold plate the items. The items may be a metal such as silver, copper, brass, nickel or gold alloy, as well as previously silver plated or gold plated items. Another object of this invention is to provide non-toxic solutions which may be applied directly to silver plated items to simultaneously gold plate and polish the items to remove any dirt or tarnish present.

A further object of this invention is to provide non-toxic plating and polishing solutions which will, even with a reduced gold component level, maintain the level of gold plating on items; that is, the solutions restore at least the amount of gold that is removed by the simultaneous polishing operation.

An additional object of this invention is to provide non-toxic creams which may be applied directly to the same types of metal items as with the inventive solutions in order to gold plate the items.

Yet another object of this invention is to provide non-toxic creams which simultaneously gold plate and polish the items. The gold component level can be adjusted so as to either maintain or restore the amount of gold plated on the items.

Yet another object of this invention is to provide non-toxic immersion baths which gold plate the same types of metal items as with the inventive solutions and creams. A further object of this invention is to use the baths to gold plate computer and electronic components and for use by manufacturing jewelers. Yet another object is to use the baths to convert silver jewelry into gold plated jewelry in the home.

Still another object of this invention is to provide concentrates, such as tablets, powders or liquids which, when mixed with water, form solutions and baths for gold plating.

These gold plating solutions and baths may be applied in a single step at ambient temperatures, without electricity or the need for a separate cleaning step or pretreatment of the item to be plated, without the use of cyanide or other toxic compositions and without the use of malodorous amine compounds.

These objects are achieved by the novel solutions, creams and baths which will now be described.

DETAILED DESCRIPTION OF THE INVENTION

The inventive solutions, creams and baths are used to apply thin, pure gold plating to a variety of metallic surfaces. The inventive compositions may be applied to base metals such as copper, nickel and brass to transform them into gold plated objects. Because the gold is not alloyed with a base metal, the resulting surfaces have an attractive, shiny gold covering.

The inventive compositions may also be applied to silver or silver plated items, including jewelry, to convert them into gold jewelry and enhance their appearance. Even gold or gold plated objects benefit by treatment with the inventive compositions. Objects are rarely composed of pure gold. Instead, gold is commonly alloyed with copper. The gold content is expressed in terms of carats, which is defined as the number of parts of gold in 24 parts of alloy. Application of the inventive compositions results in the plating of pure gold on top of a gold-copper alloy, producing a more pleasing color and shine.

Most gold items such as jewelry have a gold content of under 18 carats. A typical 14 carat item may have a thin 22 or 24 carat coating to improve its appearance. However, handling of the item will eventually cause the thin plating to wear off, exposing the underlying gold-copper alloy. Furthermore, over time, the surfaces of gold plated objects may become dirty or tarnished. Conventional polishes remove the dirt and tarnish, but also remove some of the gold. Eventually, the thin gold plating is worn off.

The inventive solutions and creams restore the fine gold appearance of such items. The solutions and creams may contain polishing agents to remove dirt and tarnish. However, they are formulated to deposit more gold than is removed by polishing. In this way, a long-lasting layer of gold plating may be built up with repeated applications. Thereafter, the level of gold plating may be maintained by use of solutions and creams having a lower gold content, which effects a cost saving.

A. Solutions

1. First Formulation

Specifically, it has been found that hard metallic items such as copper, nickel and brass, precious metals such as silver and gold alloys, as well as items previously plated with silver and gold, can be plated with gold by the use of aqueous solutions which contain a gold generating compound and a reducing compound for the gold generating compound.

The gold generating compound is a non-toxic, water soluble gold salt. Examples of such gold salts are potassium tetrachloroaurate, potassium tetrabromoaurate, potassium tetraiodoaurate, sodium tetrachloroaurate, sodium tetrabromoaurate, sodium tetraiodoaurate, sodium thiosulfatoaurate and sodium aurothiomalate. In a preferred embodiment, potassium tetrachloroaurate is used. And, if sodium thiosulfatoaurate is used, it should be handled with gloves because it can cause dermatitis.

The reducing compound is potassium sodium tartrate, potassium hydrogen tartrate or tartaric acid. In a preferred embodiment, potassium sodium tartrate is used. Although potassium hydrogen tartrate is not water-soluble, it may be suspended by the other ingredients. It is not necessary for the solution to be homogeneous for gold plating to take place because of its application by hand to the item to be plated.

It has been found that the plating of the inventive solutions may be further improved through the addition of a humectant and a polyoxyalkylene ester surfactant.

The humectant is selected from the group consisting of dipropylene glycol, diethylene glycol and triethylene glycol and serves as a wetting agent to increase the penetration of the plating ingredients. In a preferred embodiment, dipropylene glycol is used. Two or more of these compounds may also be used in combination.

A variety of polyoxyalkylene ester compounds are commercially available for use as surfactants such as polyoxyalkylene sorbitan fatty esters. In a preferred embodiment, the addition product of 20 moles of ethylene oxide with sorbitan oleate known as Tween 80 is used.

Although gold tarnishes at a much slower rate than silver when exposed to sulfur, over time some tarnishing may become noticeable. Therefore, it may be useful to include a polishing agent in the formulation. A polishing agent is also of value if gold plating is to be applied to a surface of tarnished silver. The polishing agent serves to remove any surface dirt and blemishes on the item to be gold plated. The polishing agent will be a diatomaceous earth. In a preferred embodiment, the diatomaceous earth is Kieselguhr. Particularly useful is the grade of Kieselguhr known as Dicalite 104.

The above ingredients are mixed with water to form a solution. Preferably, the water is distilled or deionized. The solution is then packaged for sale to the user, who may apply the solution directly to the metallic item to be gold plated without any mixing or handling steps. To reduce package size, the solution may be supplied in concentrated liquid form. The user would simply add water as directed, mix and apply in the usual fashion.

During storage, the polishing agent will tend to precipitate out of solution. A suspending compound may be used to maintain the polishing agent in solution. In a preferred embodiment, the suspending agent is propylene glycol. Although propylene glycol is a glycol, it is a far less effective wetting agent than those described previously and should not be used as the sole wetting agent in the solution. However, by maintaining the diactomaceous earth in solution, the propylene glycol serves to improve the polishing properties of the solution.

In some instances, the solutions may be turbid or cloudy. It has been found that the addition of common salts such as sodium chloride, potassium chloride, sodium bromide, potassium bromide, sodium iodide and potassium iodide serves to remove the turbidity and clear up the solutions. The use of sodium chloride is preferred.

2. Second Formulation

Metallic items such as copper, nickel and brass, precious metals such as silver and gold alloys, as well as items previously plated with silver and gold, can also be plated with gold by the use of aqueous solutions which contain (a) a gold generating compound, (b) a complexing compound, (c) a stabilizer and (d) water.

The gold generating compound is a non-toxic, water soluble gold salt. Examples of such gold salts are the same gold salts described above for the first formulation—potassium tetrachloroaurate, potassium tetrabromoaurate, potassium tetraiodoaurate, sodium tetrachloroaurate, sodium tetrabromoaurate, sodium tetraiodoaurate, sodium thiosulfatoaurate and sodium aurothiomalate. Potassium tetrachloroaurate is used in the preferred embodiment. Furthermore, as noted above, precautions should be observed when handling sodium thiosulfatoaurate.

The complexing compound forms complexes with the gold salt. Examples of such complexing compounds are thiourea, sodium thiosulfate, and thiomalic acid. Thiourea is preferred. Thiourea, sodium thiosulfate, and thiomalic acid complex the gold salt in such a way that the amount of "bloom" produced is eliminated or greatly reduced. "Bloom" is an undesirable reaction product (normally black in color) that settles on the surface being plated in existing methods. It should be noted, however, that thiourea, sodium thiosulfate or thiomalic acid produce better bloom-free results on silver or gold alloys or silver or gold plated items than on copper, nickel brass or bronze. But, even with copper, nickel, brass or bronze, there is still a bloom reduction when compared with existing methods. Because of unpleasant odors associated with amine based compounds, it is preferable, when using thiourea, to use up to a maximum of 1% by weight in water. This amount, however, is not limiting. A person of ordinary skill in the art can adjust the amount depending upon the amount of gold generating compound needed. An amount which keeps any unpleasant odors to a minimum is all that is required.

The stabilizer includes by way of example polyvinyl pyrrolidone, colloidal cellulose ether, hydroxy-lower alkyl starches, polyvinyl alcohol, gelatin and peptone. Polyvinyl pyrrolidone is preferred. It has been found that polyvinyl pyrrolidone provides for uniform distribution of the gold plating.

Optionally, a pH reducing agent may be used. Examples include betaine hydrochloride and betaine. Betaine hydrochloride is also known as 1-carboxy-$N_1N_1N$-trimethylmethanaminium chloride, (carboxy methyl) trimethyl ammonium chloride, acidol, lycine hydrochloride or pluchine. Betaine is also known as 1-carboxy-$N_1N_1N$- trimethyl methanaminium hydroxide inner salt, (carboxy methyl) trimethyl ammonium hydroxide inner salt or lycine. When betaine hydrochloride is used, the pH is preferably reduced to about 1.5 to 2.0. When betaine is used, the pH is preferably reduced to about 4.5 to 5.0, and most preferably about 4.6.

In addition, a buffering agent can also be added. An example of such a buffering agent includes triammonium citrate. Citric acid may also be added to such a triammonium citrate buffer but is not required. This alternate embodiment where the buffering agent includes triammonium citrate and citric acid is described, by way of example, in the following general formulation (before addition of water):

| | |
|---|---|
| Potassium tetrachloroaurate | 0.5 gm–10 gm/liter |
| Betaine hydrochloride or betaine | 0–100 gm/liter |
| Triammonium Citrate | 1 gm–30 gm/liter |
| Citric Acid | 1 gm–15 gm/liter |
| Thiourea | 0.5 gm–25 gm/liter |
| Polyvinyl Pyrrolidone (Mol. Wt 700,000 approx.) | 1 gm–20 gm/liter |

This general formulation is by way of example only and is not limiting. The amounts of the individual components can be adjusted by one of ordinary skill in the art depending on the amount of the gold generating compound needed to provide the desired plating.

In other embodiments, a catalyst such as nickel or cobalt chloride can be added. Nickel chloride is preferred.

In addition, the diatomaceous polishing agent, suspending compound used to maintain the polishing agent in solution, humectant and polyoxyalkylene ester surfactant described above in the first formulation may also be added in the second formulation.

3. Concentrate

In an alternative embodiment, the gold plating ingredients of the solution may be supplied in concentrated tablet or powder form. It is believed that this applies equally to both the first and second formulations.

Common salts such as sodium chloride, potassium chloride, sodium bromide, potassium bromide, sodium iodide and potassium iodide may be used as dilutents and binders which are mixed with the active ingredients and formed into tablets or a powder. The use of sodium chloride is preferred. The user simply adds the tablet or powder to water to form the gold plating solution. In this embodiment, a suspending compound is not required. Furthermore, as described previously, the common salt serves to eliminate turbidity and clear up the solution.

When applied to a metal such as silver, copper, nickel or brass, the novel solution quickly and easily lays down a layer of gold plating which is believed to bond directly to the surface of the item. This may be referred to as molecular plating, in contrast to electroplating. The solution penetrates through any dirt or tarnish to act directly upon the surface of the item. Inclusion of a polishing agent will result in the simultaneous removal of dirt and tarnish. The surface need not be cleaned, pre-treated or sensitized in order for the plating of gold to take place.

4. Maintenance

In another embodiment of the invention, use of a smaller concentration of gold in the solution may be used to maintain, but not necessarily replenish, the amount of gold plating on an item. Such a solution will be less costly, owing to the significantly smaller amount of expensive gold needed.

B. Creams

In still another embodiment of the invention, the gold plating compositions are in the form of creams, rather than solutions. As with the solutions, the creams are non-toxic, require no preparative steps by the user and may be applied at ambient temperatures directly to the metallic object to be plated.

1. First Formulation

The creams contain in the first formulation a gold generating compound, a reducing compound for the gold generating compound, an emulsifier, a humectant and water. Although the creams need not contain additional ingredients, ordinarily a polishing agent and a common salt will also be included.

The gold generating compound is a non-toxic, water soluble gold salt. Examples of such gold salts are potassium tetrachloroaurate, potassium tetrabromoaurate, potassium tetraiodoaurate, sodium tetrachloroaurate, sodium tetrabromoaruate, sodium tetraiodoaurate, sodium thiosulfatoaurate and sodium aurothiomalate. In a preferred embodiment, potassium tetrachloroaurate is used. And, when handling a cream containing sodium thiosulfatoaurate, the precaution noted above should be observed.

The reducing compound is potassium sodium tartrate, potassium hydrogen tartrate or tartaric acid. In a preferred embodiment, potassium sodium tartrate is used. Although potassium hydrogen tartrate is not water-soluble, it may be suspended by the other ingredients. It is not necessary for the cream to be homogeneous for gold plating to take place because of its application by hand to the item to be plated.

Alcohols are used as emulsifiers for the creams. In particular, a variety of long chain alcohols may be used, such as cetyl alcohol, the high molecular weight alcohol which is 10% sulfated known as Lanette Wax SX, tetradecyl trimethyl ammonium bromide (known as cetrimide) or the cetyl alcohol condensed with 20 ethylene oxide units known as Empilan KM20. In a preferred embodiment, Lanette Wax SX is used.

The humectant is selected from the group consisting of dipropylene glycol, diethylene glycol and triethylene glycol and serves as a wetting agent to increase the penetration of the plating ingredients. In a preferred embodiment, dipropylene glycol is used. Two or more of these compounds may also be used in combination.

The polishing agent will be a diatomaceous earth. In a preferred embodiment, the diatomaceous earth is Kieselguhr. Particularly useful is the grade of Kieselguhr known as Dicalite 104. The common salt will be one such as sodium chloride, potassium chloride, sodium bromide, potassium bromide, sodium iodide and potassium iodide. The use of sodium chloride is preferred.

The above ingredients are mixed with water to form a cream. Preferably, the water is distilled or deionized. The cream is then packaged for sale to the user, who may apply the cream directly to the object to be plated without any mixing or handling steps.

2. Second Formulation

It is believed that creams can also be made from the second formulation of a gold generating compound, complexing compound, stabilizer, and the optional components including betaine hydrochloride or betaine, buffering agents (e.g., including triammonium citrate) and nickel or cobalt chloride. The creams are prepared by the addition of the emulsifiers, humectants and water described above. Although such creams need not contain additional ingredients, a polishing agent described above may also be included.

3. Maintenance

In a further embodiment of the invention, the amount of the gold generating compound in the cream may be reduced so as to maintain, but not necessarily replenish, the amount of gold plating on an item.

C. Baths

1. First Formulation

In another embodiment of the invention, the gold plating compositions are in the form of immersion baths, rather than solutions or creams. The baths in the first formulation include a gold generating compound and a reducing compound for the gold generating compound. As with the solutions, the baths are non-toxic and require no preparative steps. The user simply immerses the metallic item to be gold plated in the bath at ambient temperatures. The metallic item can be silver, copper, nickel, brass or gold alloy, or can be previously silver plated or gold plated. As discussed below, the bath formulations may also be supplied in concentrated form, such as tablets, powders or liquids.

The gold generating compound is a non-toxic, water soluble gold salt. Examples of such gold salts are potassium tetrachloroaurate, potassium tetrabromoaurate, potassium tetraiodoaurate, sodium tetrachloroaurate, sodium tetrabromoaruate, sodium tetraiodoaurate, sodium thiosulfatoaurate and sodium aurothiomalate. In a preferred embodiment, potassium tetrachloroaurate is used. And, when handling sodium thiosulfatoaurate, the precaution noted above should be observed.

The reducing compound is potassium sodium tartrate or tartaric acid. In a preferred embodiment, potassium sodium tartrate is used. Fotassium hydrogen tartrate is not water soluble and should not be used in the immersion bath. There are no ingredients present to put it in suspension. Furthermore, a suspension would make the bath non-homogeneous. This is to be avoided, because the item to be plated is merely immersed in the bath, rather than having the plating ingredients rubbed onto the item, as is the case with solutions or creams. Therefore, a homogeneous bath is necessary to ensure even plating on the surface of the item.

As with the solutions, it has been found that, in some instances, the baths may be turbid or cloudy. The addition of common salts such as sodium chloride, potassium chloride, sodium bromide, potassium bromide, sodium iodide and potassium iodide serves to remove turbidity and clear up the baths. The use of sodium chloride is preferred.

Although the gold generating compound and the reducing compound may be mixed with water, packaged and sold, the volume of water needed for an immersion bath makes the sale of the finished bath cumbersome. It is preferred to supply the gold plating ingredients of the bath in concentrated form. In one embodiment, the composition is supplied in tablet or powder form. Common salts such as sodium chloride, potassium chloride, sodium bromide, potassium bromide, sodium iodide and potassium iodide may be used as dilutents and binders which are mixed with the active ingredients and formed into tablets or powders. In a preferred embodiment, sodium chloride is used. Furthermore, as described previously, the common salt serves to eliminate turbidity and clear up the bath. In another embodiment, the bath is supplied in concentrated liquid form.

The user will add water, preferably distilled or deionized, to a tank or other holding chamber. The concentrate, in the form of a tablet, powder or liquid, is added to the water and mixed to form the plating bath. If the bath is allowed to stand, some precipitate will form. This precipitate may be removed by filtration, leaving the bath able to gold plate as readily as when the bath was freshly prepared.

It is anticipated that a major use for the inventive bath will be to gold plate metallic items for use as computer and electronic components. In such instances, the items will be free of tarnish and without dirt or blemishes. However, plating will still occur even if the surface of the item is not clean.

The user will immerse the item to be plated in the bath. After a short immersion time, the item is removed and dried. The item will have been gold plated without the need for elaborate equipment or procedures.

The use of tartaric acid and its salts as reducing compounds provides an acidic environment for the solutions and baths. It has been found that if alkali is added so as to make the solutions and baths basic, then plating of gold will not occur.

2 Second Formulation

Applicants have found that the gold plating bath can also contain the ingredients of the second formulation—i.e. (a) a gold generating compound, (b) a complexing compound, (c) a stabilizer and (d) water.

The gold generating compound is a non-toxic, water soluble gold salt described above. Examples of such gold salts are potassium tetrachloroaurate, potassium tetrabromoaurate, potassium tetraiodoaurate, sodium tetrachloroaurate, sodium tetrabromoaurate, sodium tetraiodoaurate, sodium thiosulfatoaurate, and sodium aurothiomalate. Potassium tetrachloroaurate is used in the preferred embodiment. And, if sodium thiosulfatoaurate is used, it should be handled with gloves because it can cause dermatitis.

The complexing compound forms complexes with the gold salt. Examples of such complexing compounds are thiourea, sodium thiosulfate, and thiomalic acid. Thiourea is preferred. The "bloom" reduction results discussed above are also observed. Because of unpleasant odors associated with amine based compounds, it is desirable, when using thiourea, to use up to a maximum of 1% by weight in water. This amount, however, is not limiting. A person of ordinary skill in the art can adjust the amount depending upon the amount of gold generating compound needed. An amount which keeps any unpleasant odors to a minimum is all that is required.

The stabilizer includes by way of example polyvinyl pyrrolidone, colloidal cellulose ether, hydroxy-lower alkyl starches, polyvinyl alcohol, gelatin and peptone. Polyvinyl pyrrolidone is preferred. It has been found that polyvinyl pyrrolidone provides for uniform distribution of the gold plating.

Optionally, a pH reducing agent may be used. Examples include betaine hydrochloride and betaine. Betaine hydrochloride is also known as 1-carboxy-$N_1N_1N$-trimethylmethanaminium chloride, (carboxy methyl) trimethyl ammonium chloride, acidol, lycine hydrochloride or pluchine. Betaine is also known as 1-carboxy-$N_1N_1N$- trimethyl methanaminium hydroxide inner salt, (carboxy methyl) trimethyl ammonium hydroxide inner salt or lycine. When betaine hydrochloride is used, the pH is preferably reduced to about 1.5 to 2.0. When betaine is used, the pH is preferably reduced to about 4.5 to 5.0, and most preferably about 4.6.

In addition, a buffering agent can also be added. An example of such a buffering agent includes triammonium citrate. Citric acid may also be added to such a triammonium citrate buffer but is not required. This alternate embodiment where the buffering agent includes triammonium citrate and citric acid is described, by way of example, in the following general formulation (before addition of water):

| | |
|---|---|
| Potassium tetrachloroaurate | 0.5 gm–10 gm/liter |
| Betaine hydrochloride or betaine | 0–100 gm/liter |
| Triammonium Citrate | 1 gm–30 gm/liter |
| Citric Acid | 1 gm–15 gm/liter |
| Thiourea | 0.5 gm–25 gm/liter |
| Polyvinyl Pyrrolidone (Mol. Wt 700,000 approx.) | 1 gm–20 gm/liter |

This general formulation is by way of example only and is not limiting. The amounts of the individual components can be adjusted by one of ordinary skill in the art depending on the amount of the gold generating compound needed to provide the desired plating.

In other embodiments, a catalyst such as nickel or cobalt chloride can be added. Nickel chloride is preferred.

3. Concentrate

In another embodiment, the composition of the first or second formulation is supplied in tablet or powder form. Common salts such as sodium chloride, potassium chloride, sodium bromide, potassium bromide, sodium iodide and potassium iodide may be used as dilutents and binders which are mixed with the active ingredients and formed into tablets or powders. In a preferred embodiment, sodium chloride is used.

The user will add water, preferably distilled or deionized, to a tank or other holding chamber. The concentrate, in the form of a tablet, powder or liquid, is added to the water and mixed to form the plating bath. If the bath is allowed to stand, some precipitate will form. This precipitate may be removed by filtration, leaving the bath able to gold plate as readily as when the bath was freshly prepared.

D. Metallic Reaction Enhancer

Finally, in another embodiment of the invention, the compositions of the solutions, creams and baths can be reacted with the metallic item in the presence of a metallic reaction enhancer. The metallic reaction enhancer must be in contact with the metal being plated. It should also be a metal which does not react with the components of the composition. Examples of this reaction enhancer include aluminum or stainless steel. Aluminum or stainless steel speed up the reaction and permit the use of a lower concentration of the gold generating compound. It also removes a green tinge which may accompany the gold deposit. Tin can also be used as a metallic reaction enhancer.

Although the metallic reaction enhancer has been tested with the composition of the second formulation which includes as its basic ingredients a gold generating compound, complexing compound, stabilizer and water (and optional components including betaine hydrochloride or betaine, buffering agents and nickel or cobalt chloride), it is believed as well that the metallic reaction enhancer also enhances the reaction of the composition of the first formulation which includes as its basic ingredients a gold generating compound, a reducing compound for the gold generating compound and water (and optional components discussed earlier for the first formulation).

E. Amount of Gold Generating Compound

The amount of gold generating compound needed to provide the desired plating in solutions, creams or baths will vary from formulation to formulation tested and also according to whether a solution, cream or bath is used. However, for a given formulation, the user can establish by a few simple tests the effective amount of gold generating compound.

The following examples present illustrative but nonlimiting embodiments of the present invention.

EXAMPLE 1

A one percent solution of potassium tetrachloroaurate (GTCK) in water was made and then a small amount of potassium hydrogen tartrate was stirred in. The solution was applied to a copper surface that had previously been plated with silver. After drying, the surface was gently polished with a soft cloth. The solution produced a thin gold covering on the surface.

EXAMPLE 2

Three solutions were prepared from the following components, all parts by weight:

| | A | B | C |
|---|---|---|---|
| GTCK | 1.0 | 1.0 | 1.0 |
| Potassium hydrogen tartrate | 4.0 | — | — |
| Tartaric acid | — | 0.4 | 0.4 |
| Dicalite 104 | 10.0 | 10.0 | — |
| Water | 50.0 | 50.0 | 50.0 |

The solutions were each applied to a silvered surface following the procedure of Example 1. Solution A gave a very good cover with golden color. Solution B gave similar results with a little more yellow color. Solution C gave a weaker cover with a little more yellow color.

EXAMPLE 3

A solution was prepared from the following components, all parts by weight:

| | |
|---|---|
| GTCK | 2.0 |
| Potassium hydrogen tartrate | 6.0 |
| Dipropylene glycol | 3.0 |
| Tween 80 | 0.5 |
| Dicalite 104 | 25.0 |
| Water | 100.0 |

The solution was applied to a silver plated copper surface following the procedure of Example 1. The solution produced a very good gold covering on the surface.

EXAMPLE 4

Solutions were prepared using various amounts of GTCK together with the following components by weight: potassium hydrogen tartrate—6.0, dipropylene glycol—3.0, Tween 80—0.5, Dicalite 104—25.0, water—100.0. The amounts of GTCK in the solutions are set forth below in weight percent, together with the results when the procedure of Example 1 was followed.

| GTCK | Result |
|---|---|
| 0.062 & 0.125 | Tinge of gold cover - these solutions would be useful as gold maintenance solutions |
| 0.25 | Quite good cover, yellowish |
| 0.50 | Very good cover |
| 1.0, 1.5 & 2.0 | Very good cover, slightly superior to 0.5 |
| 3.2 | Slightly darker gold than 2.0 |

EXAMPLE 5

Three solutions were prepared from the following components, all parts by weight:

| | D | E | F |
|---|---|---|---|
| GTCK | 1.0 | 1.0 | 1.0 |
| Potassium hydrogen tartrate | 2.5 | — | — |
| Potassium sodium tartrate | — | 2.5 | — |
| Tartaric acid | — | — | 2.5 |
| Dipropylene glycol | 3.0 | 3.0 | 3.0 |
| Tween 80 | 0.5 | 0.5 | 0.5 |
| Dicalite 104 | 17.5 | 17.5 | 17.5 |
| Water | 75.5 | 75.5 | 75.5 |

The solutions were each applied to a silvered surface following the procedure of Example 1. All three solutions gave very good cover with a gold shade. Solution E was slightly superior in providing a shiny surface.

EXAMPLE 6

Four solutions were prepared to illustrate the effect of pH on the ability to gold plate a surface. The solutions consisted of the following components, all parts by weight: GTCK—1.0, dipropylene glycol—2.0, Tween 80—1.0, Dicalite 104—17.5, propylene glycol—3.0, water—70.5, together with the reducing compounds set forth below, all parts by weight:

| | G | H | I | J |
|---|---|---|---|---|
| Potassium hydrogen tartrate | 5.0 | — | — | — |
| Potassium sodium tartrate | — | 5.0 | — | 5.0 |
| Tartaric acid | — | — | 5.0 | — |
| Sodium carbonate | — | — | — | 2.0 |
| pH (approximate) | 3.5 | 6.0 | 1.5 | 10.0 |

The solutions were each applied to a silver plated copper surface following the procedure of Example 1. Solutions G and I gave strong cover with a medium yellow color. Solution H gave a less strong cover with a pale yellow color. Solution J did not provide any gold plating cover to the surface at all.

EXAMPLE 7

A solution was prepared from the following components, all parts by weight:

| | |
|---|---|
| GTCK | 1.5 |
| Potassium hydrogen tartrate | 5.0 |
| Dipropylene glycol | 2.0 |
| Tween 80 | 1.0 |
| Dicalite 104 | 18.0 |

-continued

| | |
|---|---|
| Propylene glycol | 3.0 |
| Water | 69.5 |

Portions of the solution were applied separately to a silver plated copper surface, a clean copper surface and a soiled copper surface following the procedure of Example 1. The solution gave an excellent gold cover on the silver plated copper surface, and good gold cover on both the clean and soiled copper surfaces.

EXAMPLE 8

A solution was prepared from the following components, all parts by weight:

| | |
|---|---|
| GTCK | 0.5 |
| Potassium sodium tartrate | 2.5 |
| Dipropylene glycol | 4.0 |
| Tween 80 | 0.8 |
| Dicalite 104 | 18.0 |
| Water | 74.2 |

The solution was applied to a silvered surface following the procedure of Example 1. The solution gave an excellent gold surface.

EXAMPLE 9

A solution was prepared from the following components, all parts by weight:

| | |
|---|---|
| GTCK | 0.1 |
| Potassium sodium tartrate | 2.5 |
| Dipropylene glycol | 4.0 |
| Tween 80 | 0.8 |
| Dicalite 104 | 18.0 |
| Water | 74.6 |

This solution, which contained less gold generating compound than Example 8, was applied to a silvered surface following the procedure of Example 1. The solution added a thin gold cover and would be useful as a maintenance solution for previously gold plated items.

EXAMPLE 10

A cream was prepared from the following components, all parts by weight:

| | |
|---|---|
| GTCK | 1.0 |
| Potassium sodium tartrate | 5.0 |
| Lanette wax SX | 15.0 |
| Dipropylene glycol | 4.0 |
| Dicalite 104 | 18.0 |
| Sodium chloride | 7.0 |
| Water | 58.0 |

The cream was applied as a thin layer to a nickel surface that had been electroplated with silver. The surface was rubbed with a soft cloth. The cream produced a fine gold covering on the surface.

EXAMPLE 11

A bath was prepared from the following components, all parts by weight:

| | |
|---|---|
| GTCK | 1.0 |
| Potassium sodium tartrate | 2.0 |

-continued

| | |
|---|---|
| Water | 97.0 |

A silver plated copper item was immersed in the bath for 10 seconds, then removed. A strong, pleasant gold surface was visible. The item was immersed in the bath for a further 20 seconds. The surface took on some black color, which easily rubbed off with a soft cloth to leave a very good gold surface. The item was immersed a third time for a further 30 seconds. The surface took on a dark background which again rubbed off to leave a strong gold surface.

EXAMPLE 12

Sodium chloride was added to the bath of Example 11. The sodium chloride did not affect the gold plating of the bath, but did reduce the amount of blackening. After 30 seconds of immersion no blackening was visible, and even after 5 minutes the small amount of blackening was easily rubbed off to leave a fine gold surface.

EXAMPLE 13

A tablet was prepared from the following components, all parts by weight:

| | |
|---|---|
| GTCK | 1 |
| Potassium sodium tartrate | 2 |
| Sodium chloride | 7 |

Five grams of the tablet were dissolved in 50 ml of water to form the plating bath. A silver plated item was immersed in the bath for 60 seconds, then removed. The surface had a small amount of black color, which easily rubbed off with a soft cloth to leave an excellent gold surface.

EXAMPLE 14

The bath prepared in Example 13 was allowed to stand for 48 hours. A small amount of precipitate had formed which was removed by filtration. A silver plated item was immersed in the bath for 60 seconds, then removed. The gold plating was just as good as with the original, freshly-made bath.

EXAMPLE 15

A bath was prepared following the procedure of Example 13. A nickel plated item was immersed in the bath, then removed. A gold plated surface was visible. However, immersion of a pure nickel item did not result in gold plating. The pH of the bath was then reduced to 1.0, which resulted in gold plating of the pure nickel item after immersion.

EXAMPLE 16

A composition was prepared containing the following components and concentrations in distilled water:

| | |
|---|---|
| Potassium Tetrachloroaurate | 0.25% |
| Betaine Hydrochloride | 2.50% |
| Thiourea | 0.50% |
| Triammonium Citrate | 0.50% |
| Citric Acid | 0.25% |
| Polyvinyl Pyrrolidone | 0.50% |

When a silver plated copper piece was immersed in the above composition for two minutes a very dense clear gold was deposited. The depth of gold deposit could be increased with time. Similar results were also obtained with nickel, brass, copper, and bronze. The shade on these base metals varied depending on the background color of the metal.

EXAMPLE 17

A separate composition containing the following components and concentrations was prepared:

| | |
|---|---|
| Potassium Tetrachloroaurate | 0.25% |
| Betaine | 2.50% |
| Thiourea | 0.50% |
| Triammonium Citrate | 0.50% |
| Citric Acid | 0.25% |
| Polyvinyl Pyrrolidone | 0.50% |

This composition behaved exactly like Example 16.

EXAMPLE 18

The following composition was prepared with an increased gold salt concentration:

| | |
|---|---|
| Potassium Tetrachloroaurate | 0.50% |
| Betaine Hydrochloride | 2.50% |
| Thiourea | 0.50% |
| Triammonium Citrate | 0.50% |
| Citric Acid | 0.25% |
| Polyvinyl Pyrrolidone | 0.50% |

This composition also produced similar results as Example 16, the only difference being that it took less time to deposit appreciable gold. In addition, it produced more yellow gold.

The results on nickel, brass, copper and bronze were also very similar. However, the gold deposits on those metals were not entirely bloom

EXAMPLE 19

A piece of aluminum was placed in a container and filled with the composition of Example 16. A silver plated copper piece was then placed into the container, and put into contact with the aluminum. The result was an instantaneous yellow gold deposit. The same experiment was carried out using nickel, copper, brass and bronze pieces. In all cases the result was an excellent yellow gold deposit. As noted, it is necessary that the plated articles must be in contact with the aluminum.

Other compositions such as those in Example 17, were also subjected to similar tests. All of them produced similar results. In all cases the rate of deposition was much faster than if aluminum was not used.

In addition, with the aluminum, a lower concentration of the components in distilled water is possible. One such example is:

| | |
|---|---|
| Potassium Tetrachloroaurate | 0.125% |
| Betaine Hydrochloride | 1.25% |
| Thiourea | 0.25% |
| Triammonium Citrate | 0.25% |
| Citric Acid | 0.125% |
| Polyvinyl Pyrrolidone | 0.25% |

Other metals such as stainless steel were also used. Stainless steel produced similar results as the aluminum. In every case a nice gold, yellow in color, was deposited.

EXAMPLE 20

In further experiments other additives such as nickel or cobalt chloride were added.

The following composition was prepared using nickel chloride:

| | |
|---|---|
| Potassium Tetrachloroaurate | 0.25% |
| Betaine Hydrochloride | 2.50% |
| Thiourea | 0.50% |
| Triammonium Citrate | 0.50% |
| Citric Acid | 0.25% |
| Nickel Chloride | 1.00% |
| Polyvinyl Pyrrolidone | 0.50% |

This composition, when tested, was found to deposit a much darker shade of gold. The rate of deposition was also much faster than the composition of Example 16.

The above composition, was also subjected to similar tests as in Example 19 using a small piece of aluminum. It also deposited a nice yellow gold on silver, silver plated copper, brass, bronze and nickel.

Using the above composition, it was found that it continued to deposit gold on gold.

In another composition, nickel chloride was replaced by cobalt chloride. This also produced similar results. However, the composition did not appear to last long and some precipitate was formed on leaving the composition standing for 3–4 days.

EXAMPLE 21

In the composition of Example 20, betaine hydrochloride was replaced by betaine. The components and concentrations of the new composition were as follows:

| | |
|---|---|
| Potassium Tetrachloroaurate | 0.25% |
| Betaine | 2.50% |
| Thiourea | 0.50% |
| Triammonium Citrate | 0.50% |
| Citric Acid | 0.25% |
| Nickel Chloride | 0.75% |
| Polyvinyl Pyrrolidone | 0.25% |

This composition also produced the same results as in example 20. Use of aluminum in contact with the metal piece produced similar results. Similar results could be obtained with stainless steel.

EXAMPLE 22

In a further test, nickel chloride was replaced by cobalt chloride and the composition was tested with or without the use of aluminum or stainless steel plate. In all cases it performed well.

EXAMPLE 23

In a separate experiment, compositions from Example 16 and Example 20 were tested. A silver plated copper piece was immersed in the compositions after thoroughly degreasing and cleaning. The samples were also weighed before immersing. The samples were taken out at every 15 minute interval, cleaned, dried and reweighed. The experiment was carried out for one hour. It was found that gold continued to deposit and there was a definite increase in weight after each interval.

EXAMPLE 24

All the compositions of examples 16–23 were placed in a refrigerator and cooled to below 5° C. and tested for gold deposition on a silver plated copper piece. Gold was deposited but the rate was slow.

All the compositions of above examples were placed in an oven maintained at 40° C. After 4 days the compositions were tested for deposition. All of them deposited gold with increased rate of deposition.

We claim:

1. A non-toxic solution for gold plating metallic items such as silver, copper, nickel, brass or gold alloys or silver plated or gold plated metallic items comprising effective amounts of:
   (1) a water soluble gold salt as a gold generating compound selected from the group consisting of potassium tetrachloroaurate, potassium tetrabromoaurate, potassium tetraiodoaurate, sodium tetrachloroaurate, sodium tetrabromoaurate, sodium tetraiodoaurate, sodium thiosulfatoaurate, and sodium aurothiomalate;
   (2) a complexing compound selected from the group consisting of thiourea, sodium thiosulfate, and thiomalic acid;
   (3) a stabilizer selected from the group consisting of polyvinyl pyrrolidone, colloidal cellulose ether, hydroxy lower alkyl starches, polyvinyl alcohol and peptone; and
   (4) water.

2. The solution of claim 1 wherein the water soluble gold salt is selected from the group consisting of potassium tetrachloroaurate and sodium tetrachloroaurate, the complexing compound is thiourea, and the stabilizer is polyvinyl pyrrolidone.

3. The solution of claim 1 which further comprises an effective amount of a pH reducing agent.

4. The solution of claim 1 which further comprises the addition of an effective amount of a buffering agent.

5. The solution of claim 4 wherein the buffering agent includes triammonium citrate.

6. The solution of claim 1 which further comprises an effective amount of a compound selected from the group consisting of cobalt chloride and nickel chloride.

7. The solution of claim 1 which further comprises an effective amount of a diatomaceous earth as a polishing component.

8. The solution of claim 7 which further comprises an effective amount of a compound to maintain the diatomaceous earth in suspension in the solution.

9. The solution of claim 1 which further comprises effective amounts of a polyoxyalkylene ester surfactant and a humectant selected from the group consisting of diethylene glycol, dipropylene glycol and triethylene glycol.

10. The solution of claim 1 wherein said solution is reacted with the metallic item in the presence of a metallic reaction enhancer, such that the enhancer is placed in contact with the metallic item.

11. The solution of claim 10 wherein the metallic reaction enhancer is selected from the group consisting of aluminum, stainless steel and tin.

12. A concentrate in tablet or powder form which when mixed with water provides a non-toxic solution for gold plating metallic items such as silver, copper, nickel, brass or gold alloys, or silver plated or gold plated metallic items, said concentrate comprising effective amounts of:
   (1) a water soluble gold salt as a gold generating compound selected from the group consisting of potassium tetrachloroaurate, potassium tetrabromoaurate, potassium tetraiodoaurate, sodium tetrachloroaurate, sodium tetrabromoaurate, sodium tetraiodoaurate, sodium thiosulfatoaurate, and sodium aurothiomalate;

(2) a complexing compound selected from the group consisting of thiourea, sodium thiosulfate, and thiomalic acid;

(3) a stabilizer selected from the group consisting of polyvinyl pyrrolidone, colloidal cellulose ether, hydroxy lower alkyl starches, polyvinyl alcohol and peptone;

(4) a polyoxyalkylene ester surfactant;

(5) a humectant selected from the group consisting of diethylene glycol, dipropylene glycol and triethylene glycol; and (6) a salt selected from the group consisting of sodium chloride, potassium chloride, sodium bromide, potassium bromide, sodium iodide and potassium iodide.

13. The concentrate of claim 12 wherein the water soluble gold salt is selected from the group consisting of potassium tetrachloroaurate and sodium tetrachloroaurate, the complexing compound is thiourea, and the stabilizer is polyvinyl pyrrolidone.

14. The concentrate of claim 12 which further comprises an effective amount of a compound selected from the group consisting of betaine hydrochloride and betaine.

15. The concentrate of claim 12 which further comprises the addition of an effective amount of a buffering agent.

16. The concentrate of claim 15 wherein the buffering agent includes triammonium citrate.

17. The concentrate of claim 12 which further comprises an effective amount of a compound selected from the group consisting of cobalt chloride and nickel chloride.

18. The concentrate of claim 12 which further comprises an effective amount of a diatomaceous earth as a polishing component.

19. A non-toxic solution for polishing and maintaining the amount of gold on a gold plated article, by restoring at least the amount of gold removed by that polishing, comprising effective amounts of:

(1) a water soluble gold salt as a gold generating compound selected from the group consisting of potassium tetrachloroaurate, potassium tetrabromoaurate, potassium tetraiodoaurate, sodium tetrachloroaurate, sodium tetrabromoaurate, sodium tetraiodoaurate, sodium thiosulfatoaurate, and sodium aurothiomalate;

(2) a complexing compound selected from the group consisting of thiourea, sodium thiosulfate, and thiomalic acid;

(3) a stabilizer selected from the group consisting of polyvinyl pyrrolidone, colloidal cellulose ether, hydroxy lower alkyl starches, polyvinyl alcohol and peptone;

(4)a polyoxyalkylene ester surfactant;

(5a humectant selected from the group consisting of diethylene glycol, dipropylene glycol and triethylene glycol;

(6) a diatomaceous earth as a polishing agent; and (7) water.

20. The solution of claim 19 wherein the water soluble gold salt is selected form the group consisting of potassium tetrachloroaurate and sodium tetrachloroaurate, the complexing compound is thiourea and the stabilizer is polyvinyl pyrrolidone.

21. The solution of claim 19 which further comprises an effective amount of a pH reducing agent.

22. The solution of claim 19 which further comprises the addition of an effective amount of a buffering agent.

23. The solution of claim 22 wherein the buffering agent includes triammonium citrate.

24. The solution of claim 19 which further comprises an effective amount of a compound selected from the group consisting of cobalt chloride and nickel chloride.

25. The solution of claim 19 which further comprises an effective amount of a compound to maintain the diatomaceous earth in suspension in the solution.

26. The solution of claim 19 wherein said solution is reacted with the article in the presence of a metallic reaction enhancer, such that the enhancer is placed in contact with the article.

27. The solution of claim 26 wherein the metallic reaction enhancer is selected from the group consisting of aluminum, stainless steel and tin.

28. A non-toxic cream for gold plating metallic items such as silver, copper, nickel, brass or gold alloys or silver plated or gold plated metallic items comprising effective amounts of:

(1) a water soluble soluble gold salt as a gold generating compound selected from the group consisting of potassium tetrachloroaurate, potassium tetrabromoaurate, potassium tetraiodoaurate, sodium tetrachloroaurate, sodium tetrabromoaurate, sodium tetraiodoaurate, sodium thiosulfatoaurate, and sodium aurothiomalate;

(2) a complexing compound selected from the group consisting of thiourea, sodium thiosulfate, and thiomalic acid;

(3) a stabilizer selected from the group consisting of polyvinyl pyrrolidone, colloidal cellulose ether, hydroxy lower alkyl starches, polyvinyl alcohol and peptone;

(4) an alcohol as an emulsifier;

(5) a humectant selected from the group consisting of diethylene glycol, dipropylene glycol and triethylene glycol; and (6) water.

29. The cream of claim 28 wherein the water soluble gold salt is selected from the group consisting of potassium tetrachloroaurate and sodium tetracholoraurate, the complexing compound is thiourea and the stabilizer is polyvinyl pyrrolidone.

30. The cream of claim 28 which further comprises an effective amount of a compound selected from the group consisting of betaine hydrochloride and betaine.

31. The cream of claim 28 which further comprises the addition of an effective amount of a buffering agent.

32. The cream of claim 31 wherein the buffering agent includes triammonium citrate.

33. The cream of claim 28 which further comprises an effective amount of a compound selected from the group consisting of cobalt chloride and nickel chloride.

34. The cream of claim 28 which further comprises an effective amount of a diatomaceous earth as a polishing component.

35. The cream of claim 28 wherein said cream is reacted with the metallic item in the presence of a metallic reaction enhancer, such that the metallic reaction enhancer is placed in contact with the metallic item.

36. The cream of claim 35 wherein the metallic reaction enhancer is selected from the group consisting of aluminum, stainless steel and tin.

37. A non-toxic cream for polishing and maintaining the amount of gold on a gold plated article, by restoring at least the amount of gold removed by that polishing, comprising effective amounts of:

(1) a water soluble gold salt as a gold generating compound selected from the group consisting of potassium tetrachloroaurate, potassium tetrabromoaurate, potassium tetraiodoaurate, sodium tetrachloroaurate, sodium tetrabromoaurate, sodium tetraiodoaurate, sodium thiosulfatoaurate, and sodium aurothiomalate;

(2) a complexing compound selected from the group consisting of thiourea, sodium thiosulfate, and thiomalic acid;

(3) a stabilizer selected from the group consisting of polyvinyl pyrrolidone, colloidal cellulose ether, hydroxy lower alkyl starches, polyvinyl alcohol and peptone;

(4) an alcohol as an emulsifier;

(5) a humectant selected from the group consisting of diethylene glycol, dipropylene glycol and triethylene glycol;

(6) a diatomaceous earth as a polishing agent; and (7) water.

38. The cream of claim 37 wherein the water soluble gold salt is selected from the group consisting of potassium tetrachloroaurate and sodium tetrachloroaurate, the complexing compound is thiourea and the stabilizer is polyvinyl pyrrolidone.

39. The cream of claim 37 which further comprises an effective amount of a compound selected from the group consisting of betaine hydrochloride and betaine.

40. The cream of claim 37 which further comprises the addition of an effective amount of a buffering agent.

41. The cream of claim 40 wherein the buffering agent includes triammonium citrate.

42. The cream of claim 37 which further comprises an effective amount of a compound selected from the group consisting of cobalt chloride and nickel chloride.

43. The cream of claim 37 wherein said cream is reacted with the article in the presence of a metallic reaction enhancer, such that the enhancer is placed in contact with the article.

44. The cream of claim 43 wherein the metallic reaction enhancer is selected from the group consisting of aluminum, stainless steel and tin.

45. A non-toxic immersion bath for gold plating metallic items such as silver, copper, nickel, brass or gold alloys or silver plated or gold plated metallic items comprising effective amounts of:

(1) a water soluble gold salt as a gold generating compound selected from the group consisting of potassium tetrachloroaurate, potassium tetrabromoaurate, potassium tetraiodoaurate, sodium tetrachloroaurate, sodium tetrabromoaurate, sodium tetraiodoaurate, sodium thiosulfatoaurate, and sodium aurothiomalate;

(2) a complexing compound selected from the group consisting of thiourea, sodium thiosulfate, and thiomalic acid;

(3) a stabilizer selected from the group consisting of polyvinyl pyrrolidone, colloidal cellulose ether, hydroxy lower alkyl starches, polyvinyl alcohol and peptone; and (4) water.

46. The bath of claim 45 which further comprises an effective amount of a pH reducing agent.

47. The bath of claim 45 which further comprises the addition of an effective amount of a buffering agent.

48. The bath of claim 47 wherein the buffering agent includes triammonium citrate.

49. The bath of claim 45 which further comprises an effective amount of a compound selected from the group consisting of cobalt chloride and nickel chloride.

50. The bath of claim 45 wherein said bath is reacted with the metallic item in the presence of a metallic reaction enhancer such that the enhancer is placed in contact with the metallic item.

51. The bath of claim 50 wherein the metallic reaction enhancer is selected from the group consisting of aluminum, stainless steel and tin.

52. The bath of claim 45 which further comprises (1) a pH reducing agent, and (2) a buffering agent.

53. The bath of claim 52 wherein said bath is reacted with the metallic item in the presence of a metallic reaction enhancer, such that the enhancer is placed in contact with the metallic item.

54. The bath of claim 53 wherein the metallic reaction enhancer is selected from the group consisting aluminum, stainless steel and tin.

55. The bath of claim 54 wherein the water soluble gold salt is selected from the group consisting of potassium tetrachloroaurate and sodium tetrachloroaurate, the complexing compound is thiourea, the stabilizer is polyvinyl pyrrolidone, the pH reducing agent is selected from the group consisting of betaine and betaine hydrochloride, the buffering agent includes triammonium citrate and citric acid, and the metallic reaction enhancer is aluminum.

56. A concentrate in tablet or powder form which when mixed with water provides an immersion bath for gold plating metallic items such as silver, copper, nickel, brass or gold alloys, or silver plated or gold plated metallic items, said concentrate comprising effective amount of:

(1) a water soluble gold salt as a gold generating compound selected from the group consisting of potassium tetrachloroaurate, potassium tetrabromoaurate, potassium tetraiodoaurate, sodium tetrachloroaurate, sodium tetrabromoaurate, sodium tetraiodoaurate, sodium thiosulfatoaurate, and sodium aurothiomalate;

(2) a complexing compound selected from the group consisting of thiourea, sodium thiosulfate, and thiomalic acid;

(3) a stabilizer selected from the group consisting of polyvinyl pyrrolidone, colloidal cellulose ether, hydroxy lower alkyl starches, polyvinyl alcohol and peptone; and (4) a salt selected from the group consisting of sodium chloride, potassium chloride, sodium bromide, potassium bromide, sodium iodide, and potassium iodide.

57. The concentrate of claim 56 wherein the water soluble gold salt is selected from the group consisting of potassium tetrachloroaurate and sodium tetrachloroaurate, the complexing compound is thiourea, and the stabilizer is polyvinyl pyrrolidone.

58. The concentrate of claim 56 which further comprises an effective amount of a compound selected from the group consisting of betaine hydrochloride and betaine.

59. The concentrate of claim 56 which further comprises the addition of an effective amount of a buffering agent.

60. The concentrate of claim 59 in which the buffering agent includes triammonium citrate.

61. The concentrate of claim 56 which further comprises an effective amount of a compound selected from the group consisting of cobalt chloride and nickel chloride.

62. A non-toxic solution for gold plating metallic items such as silver, copper, nickel, brass or gold alloys, or silver plated or gold plated metallic items comprising effective amount of:

(1) a water soluble gold salt as a gold generating compound selected from the group consisting of potassium tetrachloroaurate, potassium tetrabromoaurate, potassium tetraiodoaurate, sodium tetrachloroaurate, sodium tetrabromoaurate, sodium tetraiodoaurate, sodium thiosulfatoaurate, and sodium aurothiomalate;

(2) a reducing compound for said gold generating compound which is selected from the group consisting of potassium sodium tartrate, potassium hydrogen tartrate and tartaric acid; and (3) water; said solution being reacted with the metallic item in the presence of a metallic reaction enhancer, such that the enhancer is placed in contact with the metallic item.

63. The solution of claim 62 wherein the metallic reaction enhancer is selected from the group consisting of aluminum, stainless steel, and tin.

64. A non-toxic cream for gold plating metallic items such as silver, copper, nickel, brass or gold alloys, or silver plated or gold plated metallic items comprising effective amounts of:

(1) a water soluble gold salt as a gold generating compound selected from the group consisting of potassium tetrachloroaurate, potassium tetrabromoaurate, potassium tetraiodoaurate, sodium tetrachloroaurate, sodium tetrabromoaurate, sodium tetraiodoaurate, sodium thiosulfatoaurate, and sodium aurothiomalate;

(2) a reducing compound for said gold generating compound which is selected from the group consisting of potassium sodium tartrate, potassium hydrogen tartrate and tartaric acid;

(3) an alcohol as an emulsifier;

(4) a humectant selected from the group consisting of diethylene glycol, dipropylene glycol and triethylene glycol; and (5) water; said cream being reacted with the metallic item in the presence of a metallic reaction enhancer, such that the enhancer is placed in contact with the metallic item.

65. The cream of claim 64 wherein the metallic reaction enhancer is selected from the group consisting of aluminum, stainless steel and tin.

66. A non-toxic immersion bath for gold plating metallic items such as silver, copper, nickel, brass or gold alloys, or silver plated or gold plated metallic items comprising effective amounts of:

(1) a water soluble gold salt as a gold generating compound selected from the group consisting of potassium tetracholoraurate, potassium tetrabromoaurate, potassium tetraiodoaurate, sodium tetraiodoaurate, sodium tetrabromoaurate, sodium tetraiodoaurate, sodium thiosulfatoaurate, and sodium aurothiomalate;

(2) a reducing compound for said gold generating compound which is potassium sodium tartrate or tartaric acid; and (3) water; said bath being reacted with the metallic item in the presence of a metallic reaction enhancer, such that the enhancer is placed in contact with the metallic item.

67. The bath of claim 66 wherein the metallic reaction enhancer is selected from the group consisting of aluminum, stainless steel, and tin.

68. The bath of claim 66 which further comprises a salt to reduce turbidity which is selected from the group consisting of sodium chloride, potassium chloride, sodium bromide, potassium bromide, sodium iodide and potassium iodide.

69. A non-toxic solution for gold plating metallic items such as silver, copper, nickel, brass or gold alloys, or silver plated or gold plated metallic items comprising effective amount of: (1) a water soluble gold salt which is sodium aurothiomalate; (2) a reducing compound for said gold salt which is selected from the group consisting of potassium sodium tartrate, potassium hydrogen tartrate and tartaric acid; and (3) water.

70. A non-toxic solution for polishing and maintaining the amount of gold on a gold plated article, by restoring at least the amount of gold removed by that polishing, comprising effective amounts of: (1) a water soluble gold salt which is sodium aurothiomalate; (2) a reducing compound for said gold salt which is selected from the group consisting of potassium sodium tartrate, potassium hydrogen tartrate and tartaric acid; (3) a polyoxyalkylene ester surfactant; (4) a humectant selected from the group consisting of diethylene glycol, dipropylene glycol and triethylene glycol; (5) a diatomaceous earth as a polishing agent; and (6) water.

71. A non-toxic cream for gold plating metallic items such as silver, copper, nickel, brass or gold alloys, or silver plated or gold plated metallic items comprising effective amounts of: (1) a water soluble gold salt which is sodium aurothiomalate; (2) a reducing compound for said gold salt which is selected from the group consisting of potassium sodium tartrate, potassium hydrogen tartrate and tartaric acid; (3) an alcohol as an emulsifier; (4) a humectant selected from the group consisting of diethylene glycol, dipropylene glycol and triethylene glycol; and (5) water.

72. A non-toxic cream for polishing and maintaining the amount of gold on a gold plated article, by restoring at least the amount of gold removed by that polishing, comprising effective amounts of: (1) a water soluble gold salt which is sodium aurothiomalate; (2) a reducing compound for said gold salt which is selected from the group consisting of potassium sodium tartrate, potassium hydrogen tartrate and tartaric acid; (3) an alcohol as an emulsifier; (4) a humectant selected from the group consisting of diethylene glycol, dipropylene glycol and triethylene glycol; (5) a diatomaceous earth as a polishing agent; and (6) water.

73. A non-toxic immersion bath for gold plating metallic items such as silver, copper, nickel, brass or gold alloys, or silver plated or gold plated metallic items comprising effective amounts of: (1) a water soluble gold salt which is sodium aurothiomalate; (2) a reducing compound for said gold salt which is potassium sodium tartrate or tartaric acid; and (3) water.

74. A composition for gold plating metallic items or for polishing and maintaining the amount of gold on a gold plated article comprising effective amounts of:

(1) a water soluble gold salt as a gold generating compound selected from the group consisting of potassium tetrachloroaurate, potassium tetrabromoaurate, potassium tetraiodoaurate, sodium tetrachloroaurate, sodium tetrabromoaurate, sodium tetraiodoaurate, sodium thiosulfatoaurate, and sodium aurothiomalate;

(2) a complexing compound selected from the group consisting of thiourea, sodium thiosulfate, and thiomalic acid; and (3) a stabilizer selected from the group consisting of polyvinyl pyrrolidone, colloidal cellulose ether, hydroxyl lower alkyl starches polyvinyl alcohol, and peptone.

75. A composition for gold plating metallic items or for polishing and maintaining the amount of gold on a gold plated article comprising effective amounts of:

(a) a gold salt selected from the group consisting of potassium tetrachloroaurate, potassium tetrebromoaurate, potassium tetraiodoaurate, sodium tetrachloroaurate, sodium tetrabromoaurate, sodium tetraiodoaurate, sodium thiosulfatoaurate and sodium aurothiomalate and (b) a reducing compound for said gold salt selected from the group consisting of potassium sodium tartrate, potassium hydrogen tartrate and tartaric acid or a complexing compound for said gold salt selected from the group consisting of thiourea, sodium thiosulfate and thiomalic acid, and wherein said composition is reacted with the metallic item or article in the presence of a metallic reaction enhancer, such that the enhancer is placed in contact with the metallic item or article.

76. The composition of claim 75 wherein the metallic reaction enhancer is selected from the group consisting of aluminum, stainless steel, and tin.

77. The solution of claim 3 wherein the pH reducing agent is selected from the group consisting of betaine hydrochloride and betaine.

78. The solution of claim 21 wherein the pH reducing agent is selected from the group consisting of betaine hydrochloride and betaine.

79. The bath of claim 46 wherein the pH reducing agent is selected from the group consisting of betaine hydrochloride and betaine.

80. The bath of claim 52 wherein the pH reducing agent is selected from the group consisting of betaine hydrochloride and betaine.

81. The solution of claim 11 wherein the water soluble gold salt is selected from the group consisting of potassium tetrachloroaurate and sodium tetrachloroaurate, the complexing compound is thiourea, the stabilizer is polyvinyl pyrrolidone, and the metallic reaction enhancer is aluminum and which further comprises a pH reducing agent and buffering agent.

82. The solution of claim 81 wherein the pH reducing agent is selected from the group consisting of betaine hydrochloride and betaine and the buffering agent includes triammonium citrate and citric acid.

* * * * *